US007063451B2

(12) United States Patent
Shen

(10) Patent No.: US 7,063,451 B2
(45) Date of Patent: Jun. 20, 2006

(54) TRACK LIGHT ASSEMBLY AND TRACK LIGHT EQUIPPED WITH THE SAME

(76) Inventor: Wei Hong Shen, 6F, No. 649-9, Chung Cheng Rd., Hsinchuang City, Taipei Hsien (TW)

( * ) Notice: Subject to any disclaimer, the term of this patent is extended or adjusted under 35 U.S.C. 154(b) by 72 days.

(21) Appl. No.: 10/828,221

(22) Filed: Apr. 21, 2004

(65) Prior Publication Data

US 2005/0237769 A1 Oct. 27, 2005

(51) Int. Cl.
*H01R 33/00* (2006.01)

(52) U.S. Cl. ..... 362/648; 362/226

(58) Field of Classification Search ..... 362/648, 362/226

See application file for complete search history.

(56) References Cited

U.S. PATENT DOCUMENTS

2003/0012026 A1* 1/2003 Shen ..... 362/382
2005/0152132 A1* 7/2005 Bernhart et al. ..... 362/147

FOREIGN PATENT DOCUMENTS

TW 90210988 1/2002

* cited by examiner

*Primary Examiner*—Renee Luebke
*Assistant Examiner*—William Carter
(74) *Attorney, Agent, or Firm*—Rosenberg, Klein & Lee

(57) ABSTRACT

A track light assembly adopted for a track light has a conduction track having two lateral sidewalls opposing each other, two lateral retaining members extending inwardly from the two lateral sidewalls respectively, a cavity formed between the two lateral sidewalls, and a cutout formed between the two lateral retaining member and communicating with the cavity. The track light assembly further includes an insulation strip disposed in the cavity and having an opening relating to the cutout, and a conduction strip made of conductive materials. The conduction strip is partially disposed in the insulation strip and partially exposed out of the insulation strip via the opening. The track light is provided firm connection to the track light assembly with an easy assembly and removal, the track light assembly can prolong the life thereof accordingly.

8 Claims, 10 Drawing Sheets

TRACK LIGHT ASSEMBLY AND TRACK LIGHT EQUIPPED WITH THE SAME

BACKGROUND OF THE INVENTION

1. Field of the Invention

The present invention relates to a track light assembly, and particularly relates to a track light assembly adopted for a track light.

2. Background of the Invention

Track lights provide not only lighting but also decoration. Track lighting includes a track light assembly combined with lamps, and is widely used in various applications.

Referring to FIG. 1, a conventional track light assembly adopted for a track light 8 discloses a track structure 5, two insulation strips 6, and two conduction strips 7. The track structure 5 has two engaging slots 50 formed in two lateral sides thereof to accommodate the two insulation strips 6 therein. The two insulation strips 6 include two clamping recesses 60 for receiving the two conduction strips 7 sandwiched therein. The track light 8 includes two clipping arms 80 and two connection members 81 screwed on upper portions of the two clipping arms 80, respectively. The two connection members 81 are engaged with the conduction strips 7, respectively, to secure the track light 8 the track structure 5. The two conduction strips 7 provide positive and negative power sources to the track light 8 via the two connection members 81, respectively.

Obviously, the conventional track light assembly provides a complicated structure, and track light 8 is correspondingly as complicated as the conventional track light assembly. Thus, the costs, the weight, and the space the conventional track light assembly occupies increase accordingly. The track light 8 must be manually mounted in the track structure 5, and members in the combination drop off easily. Furthermore, the track structure 5 is decorative only and lacks further application.

The inventor of the present invention filed a track light assembly structure for a track light in R.O.C Patent Application No. 90210988, on 29, Jun. 2001. The track light assembly structure for a track light was later granted a patent on 23, Mar. 2002. FIG. 2 illustrates the track light assembly structure for a track light 8' that includes a conduction track 5', an insulation strip 6' disposed in the conduction track 5', and a conduction strip 7' arranged in the insulation strip 6'. The conduction track 5' has a thread 51' mating with that thread 81' of the track light 8'. Therefore, the costs, the weight and the space are decreased thereby. However, the size of the conduction track 5' cannot be controlled precisely, and the thread 51' deforms easily. The track light 8' cannot connect to the conduction track 5' smoothly because the thread 51' does not align with threads 81'; the assembly process thus is not smooth, the assembly speed decreases, and the finished product after assembly does not provide a secure connection thereby. The threads 51' and 81' are easily damaged during assembly and disassembly.

Hence, an improvement over the prior art is required to overcome the disadvantages thereof.

SUMMARY OF INVENTION

The primary object of the invention is therefore to specify a track light assembly that provides an easily assembled and disassembled track light.

The secondary object of the invention is therefore to specify a track light assembly that provides a firm connection to the track light.

The third object of the invention is therefore to specify a track light assembly with long service life.

According to the invention, these objects are achieved by a track light assembly adopted for a track light including a conduction track having two lateral sidewalls opposing each other, two lateral retaining members extending inwardly from the two lateral sidewalls, respectively, a cavity formed between the two lateral sidewalls, and a cutout formed between the two lateral retaining member and communicating with the cavity. The track light assembly further includes an insulation strip disposed in the cavity and having an opening relating to the cutout, and a conduction strip made of conductive materials, and the conduction strip is partially disposed in the insulation strip and partially exposed by the insulation strip via the opening. The track light provides a firm connection to the track light assembly with an easy assembly and removal, and the service life of the track light assembly is thereby extended.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
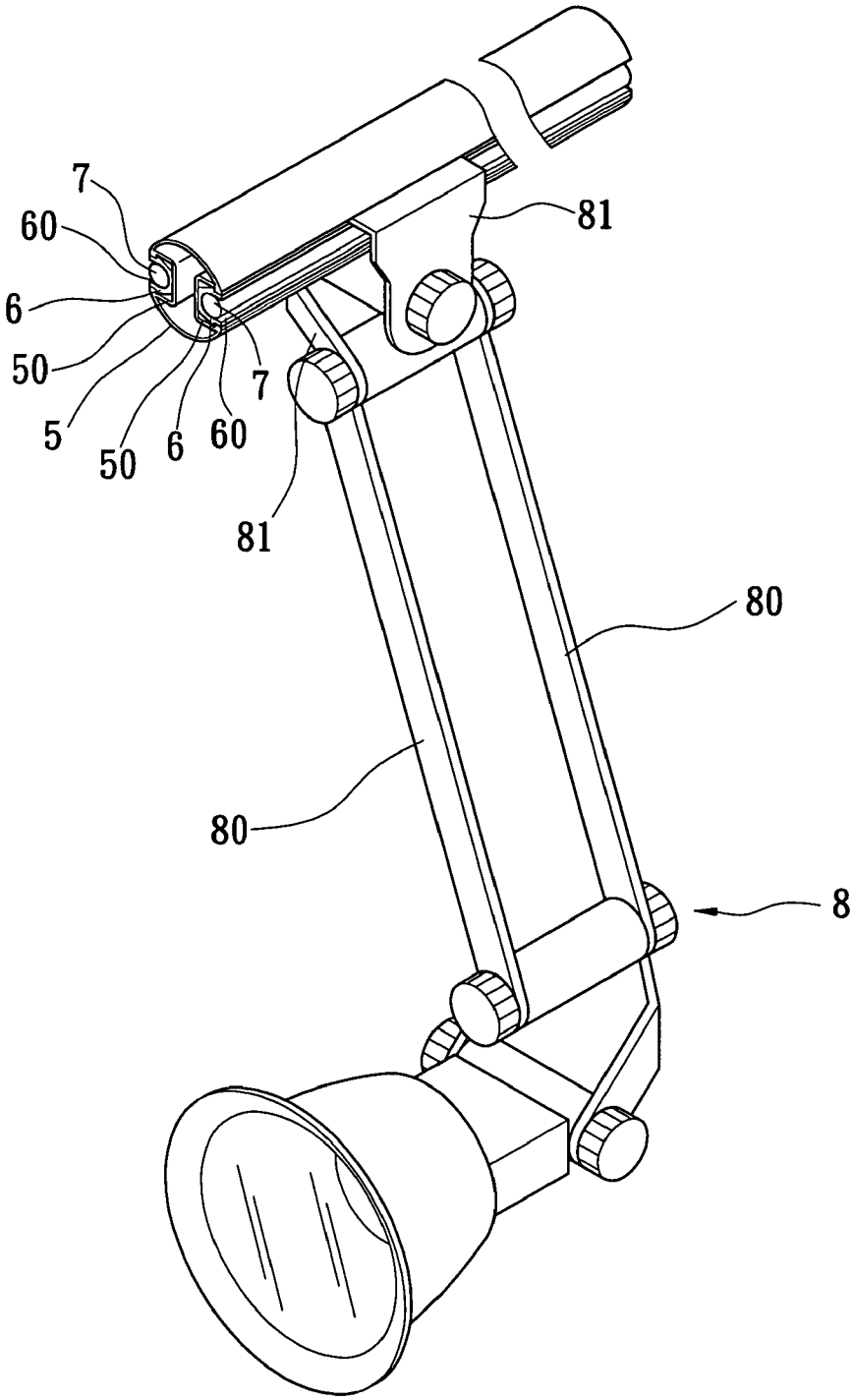
FIG. 1 PRIOR ART
FIG. 1 is a perspective view of a first conventional track light assembly.
Figure 2:
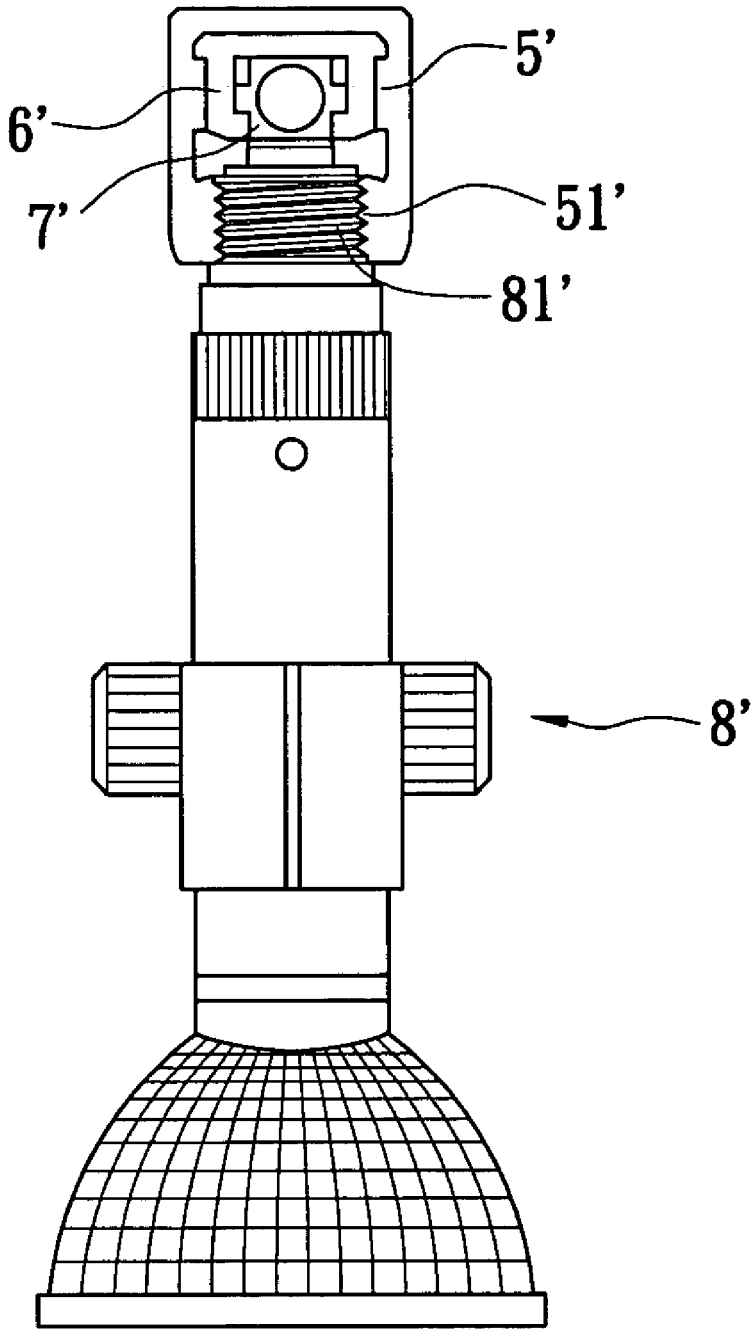
FIG. 2 PRIOR ART
FIG. 2 is a side view of a second conventional track light assembly.
Figure 3:
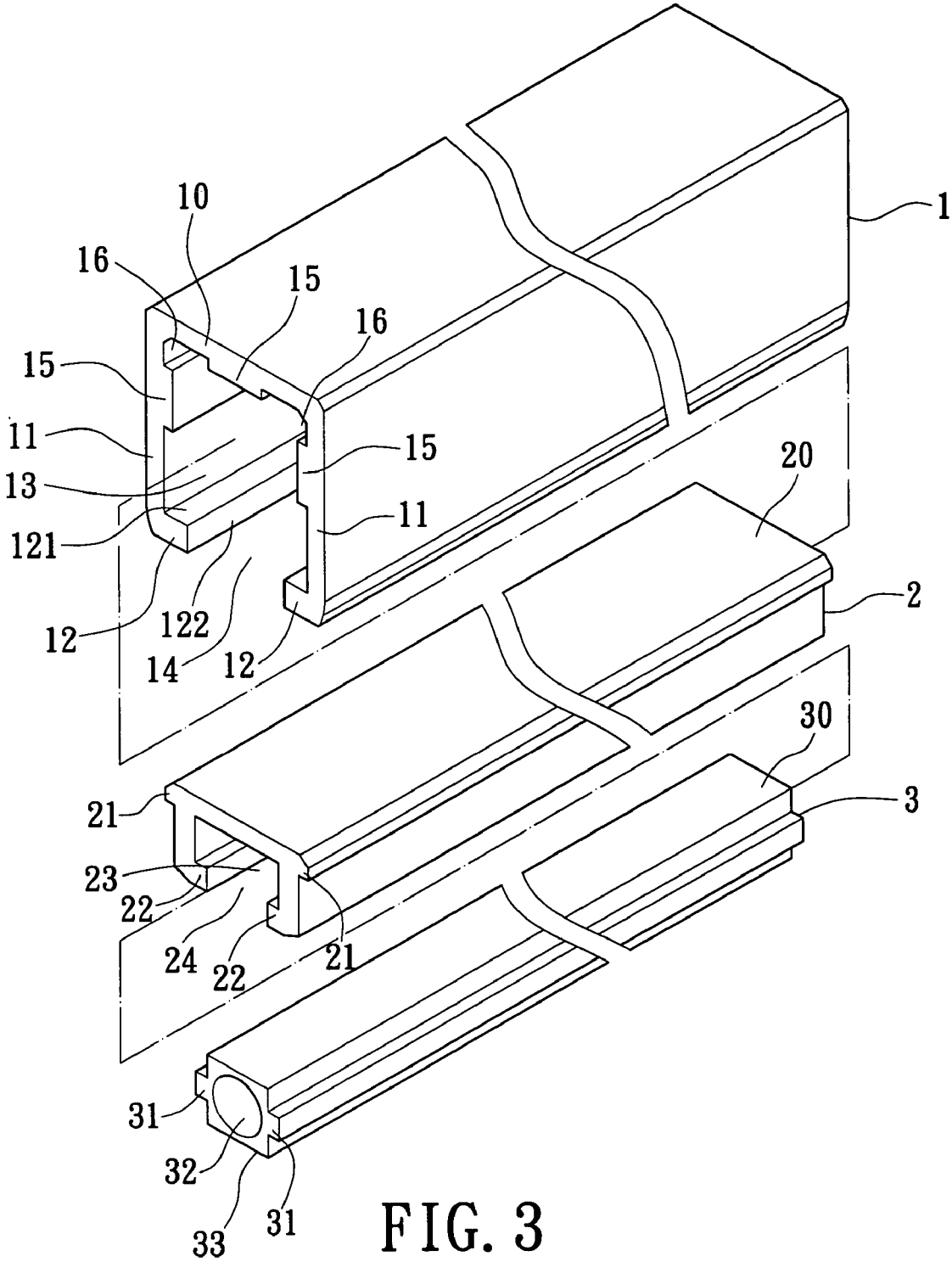
FIG. 3 is a decomposition view of a track light assembly of according to a first embodiment of the present invention.
Figure 4:
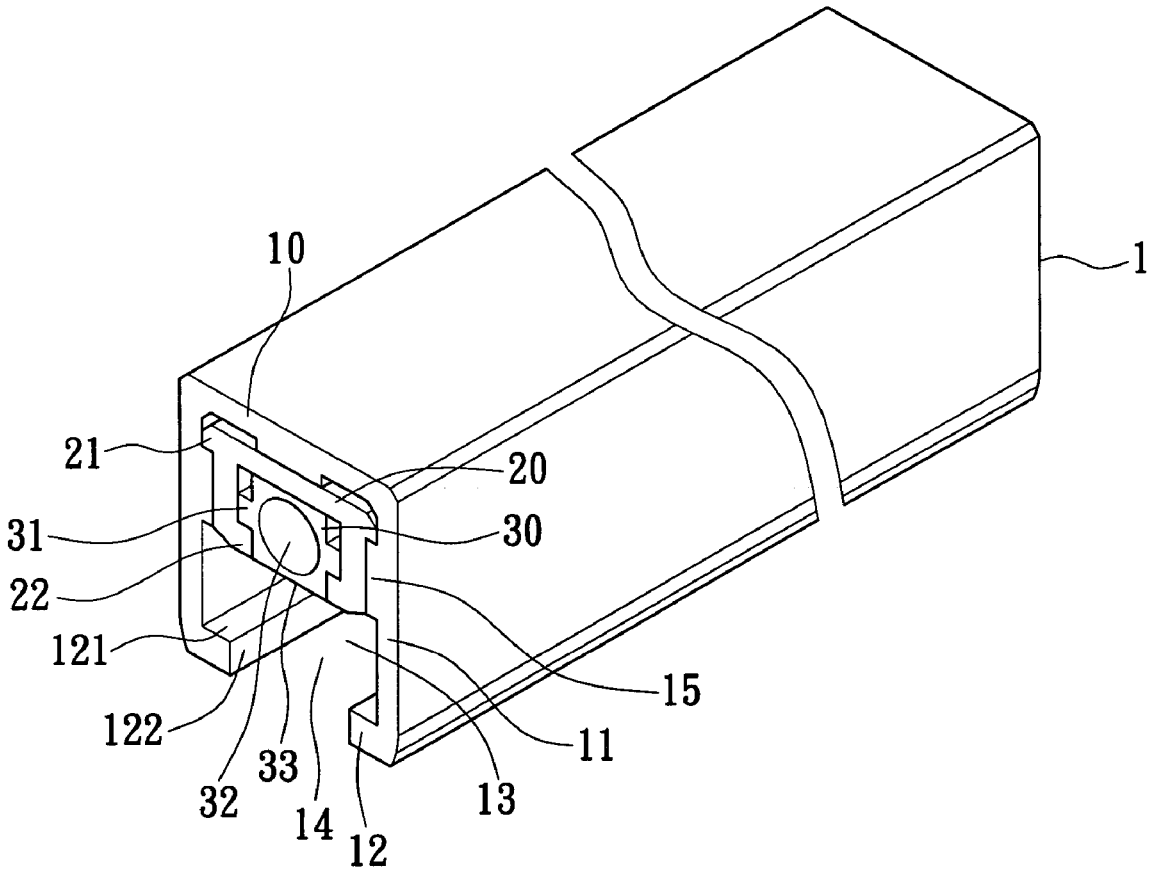
FIG. 4 is a perspective view of the track light assembly of according to the first embodiment of the present invention.

With respect to FIGS. 3 and 4, a first embodiment of the present invention discloses a track light assembly adopted for a track light including a conduction track 1, an insulation strip 2, and a conduction strip 3.

The conduction track 1 is an integral piece made of conductive material, such as extruded aluminum material. The conduction track 1 includes a base 10, two lateral sidewalls 11 opposing each other, two lateral retaining members 12 extending inwardly from the two lateral sidewalls 11, respectively, a cavity 13 formed between the two lateral sidewalls 11, and a cutout 14 formed between the two lateral retaining members 12 and communicating with the cavity 13. The two lateral sidewalls 11 have two upper portions extending from two lateral sides of the base 10. The conduction track has a horseshoe-shaped end surface. The two lateral retaining members 12 extend inwardly from two lower portions of the two lateral sidewalls 11, respectively, and each of the two lateral retaining members 12 has a first conductive surface 121 facing the cavity 13 and a side retaining surface 122 adjacent to the cutout 14. The cutout 14 is gradually reduced. The conduction track 1 includes three embosses 15 extending inwardly from the base 10 and the two lateral sidewalls 11, respectively, and two slots 16 formed between the three embosses 15, respectively.

The insulation strip 2 is disposed in the cavity 13, has an opening 24 relating to the cutout 13, and includes a partition wall 20, two side wings 21 laterally extending from the partition wall 20 outwardly, and two opposing flanges 22 extending inwardly from the partition wall 20. The partition wall 20 includes a slot 23 formed therein, the opening 24 is formed between the two opposing flanges 22 to communicate with the slot 23, the opening 24 is gradually reduced, and the insulation strip 2 has a horseshoe-shaped end surface. The insulation strip 2 accommodates the cavity 13, the partition wall 20 abuts against the three embosses 15 and the two side wings 21 mate with the two slots 16.

The conduction strip 3 is an integral piece made of conductive material, such as extruded aluminum material. The conduction strip 3 includes a base 30 disposed in the slot 23, and two projecting members 31 outwardly extending from the base 30 and retaining against the two opposing flanges 22, respectively. The conduction strip 3 has a cruciform end surface. The conduction strip 3 accommodates the insulation strip 2 via the opening 24. The conduction strip 3 is partially disposed in the insulation strip 2 and partially exposed by the insulation strip 2 via the opening 24. The conduction strip 3 includes a second conductive surface 33 exposed by the insulation strip 2 via the opening 24. The conduction strip 3 has two connection holes 32 formed on two opposing ends thereof for connection to another track light assembly via a conjunction (not shown).

Figure 5:
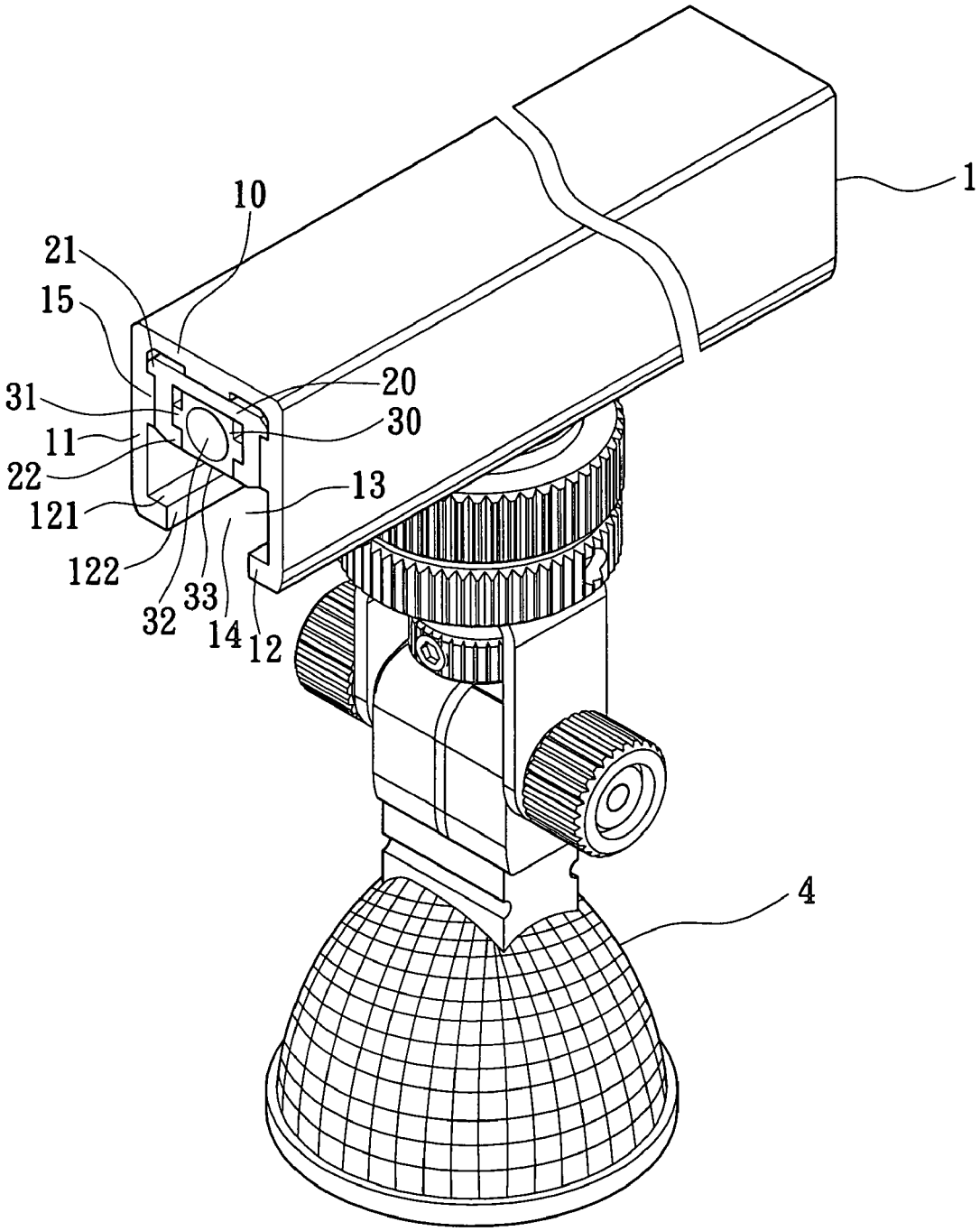
FIG. 5 is a perspective view of the track light assembly adopted for a track light of according to the first embodiment of the present invention.
Figure 6:
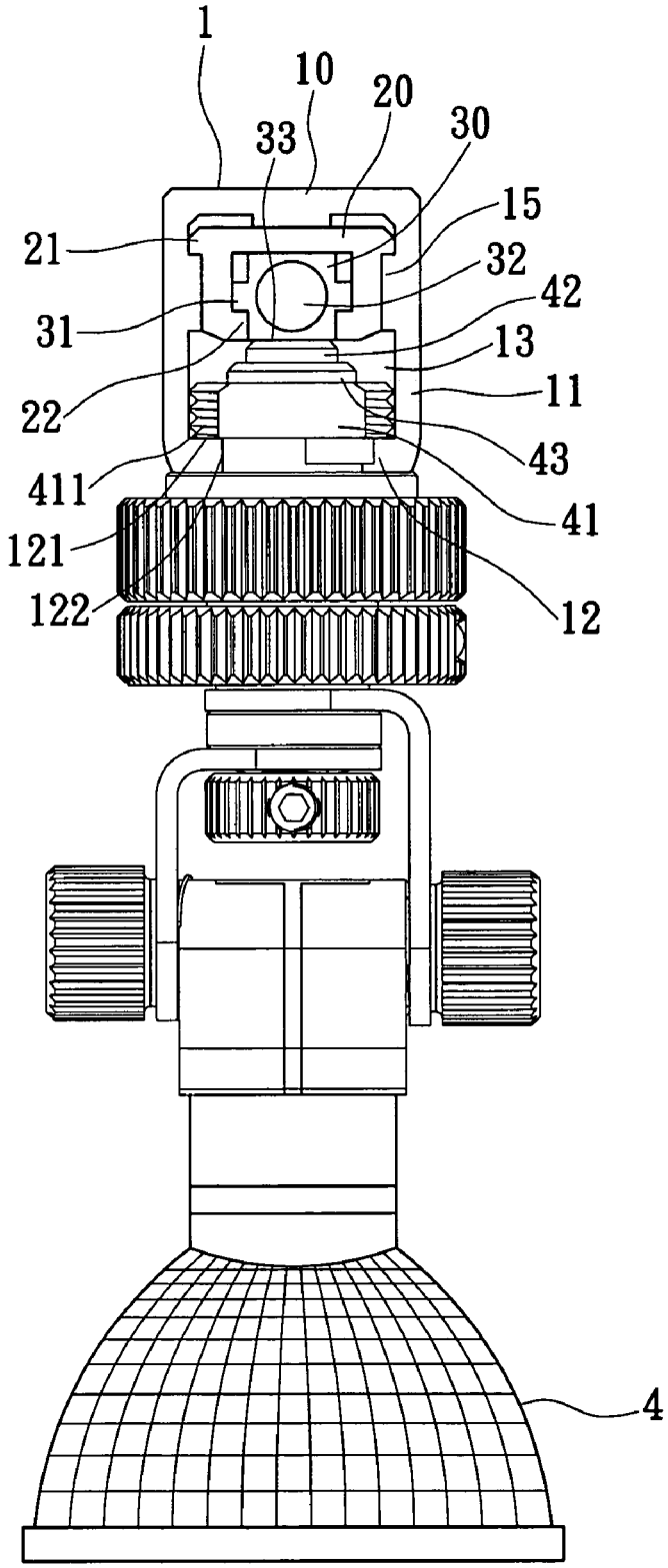
FIG. 6 is a side view of the track light assembly adopted for the track light of according to the first embodiment of the present invention.

Referring to FIGS. 5 and 6, a track light combined with the track light assembly of the present invention includes a conduction track 1, an insulation strip 2, a conduction strip 3, and a lamp 4. The conduction track 1, the insulation strip 2 and the conduction strip 3 have configurations as mentioned above. The lamp 4 includes a first electrode 41 disposed in the cavity 13 via the cutout 14 and abutting against the two lateral retaining members 12 for electrically connecting the conduction track 1, a second electrode 42 electrically connecting the conduction strip 3 via the opening 24 and the cutout 14, and an insulation member 43 insulating the first electrode 41 disposed and the second electrode 42 from each other for electrically positive and negative power sources, respectively. The first electrode 41 is rectangular, includes a thread portion 411, and penetrates the cutout 14 directly to be received in the cavity 13. The second electrode 42 retractably mates with the first electrode 41 to electrically connect to the second conductive surface 33 via the opening 24 and the cutout 14. The first electrode 41 is turned to be retained against the two retaining members 12, the first conductive surface 121 and a side retaining surface 122 in a rapid, straight, and firm manner. The first electrode 41 electrically connects to the first conductive surface 121 thereby. Therefore, the track light assembly is electrically adopted for the track light.

Figure 7:
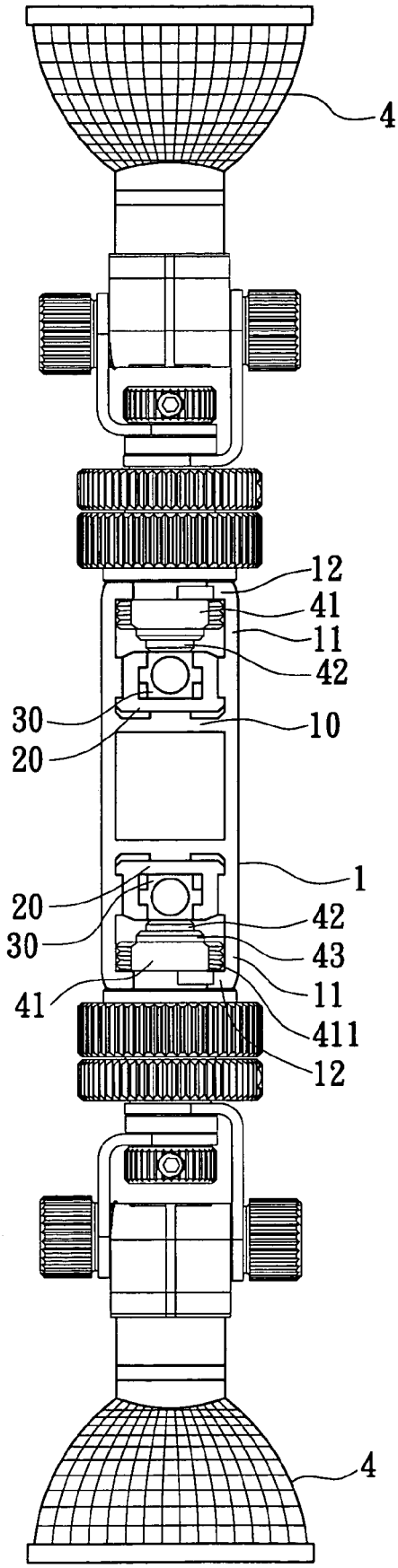
FIG. 7 is a side view of the track light assembly adopted for a track light of according to a second embodiment of the present invention.

Referring to FIG. 7, a second embodiment of the present invention discloses the conduction track 1 including two sets of the sidewalls 11 and retaining members 12 for the assembly of more lamps 4.

Figure 8:
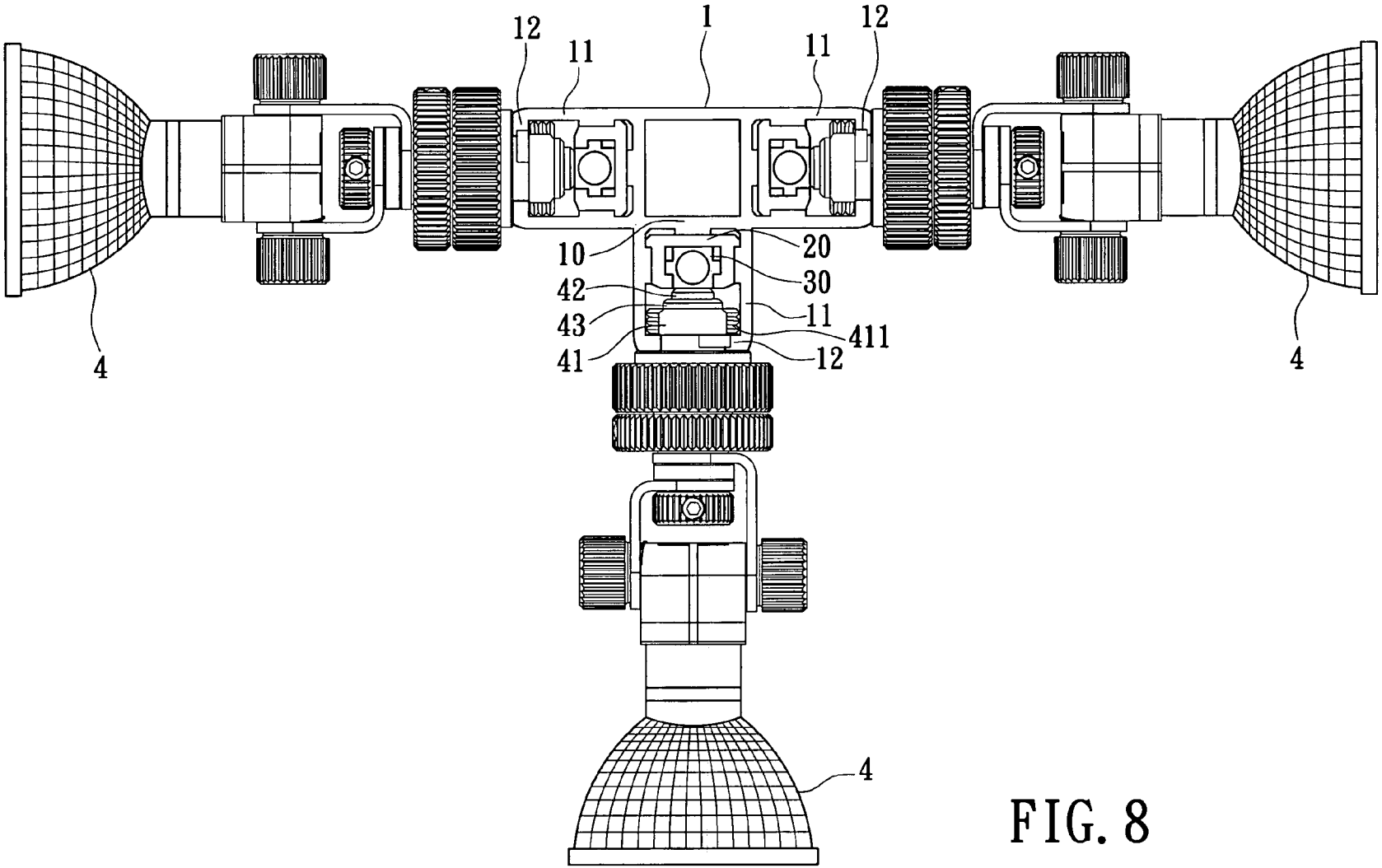
FIG. 8 is a side view of the track light assembly adopted for a track light of according to a third embodiment of the present invention.

FIG. 8 illustrates a third embodiment providing three sets of the sidewalls 11 and retaining members 12 for the assembly of more lamps 4.

Figure 9:
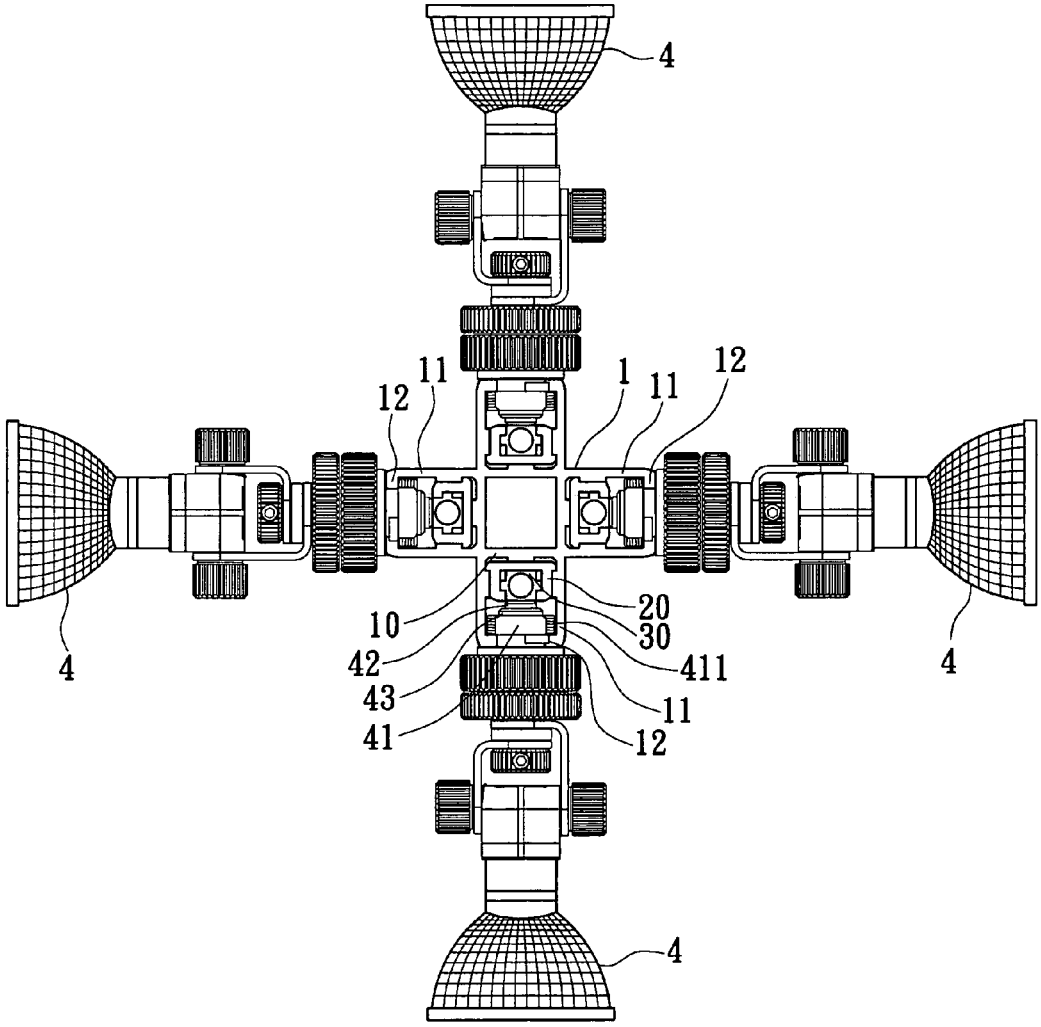
FIG. 9 is a side view of the track light assembly adopted for a track light of according to a fourth embodiment of the present invention.

FIG. 9 illustrates a fourth embodiment providing four sets of the sidewalls 11 and retaining members 12 for the assembly of more lamps 4.

Figure 10:
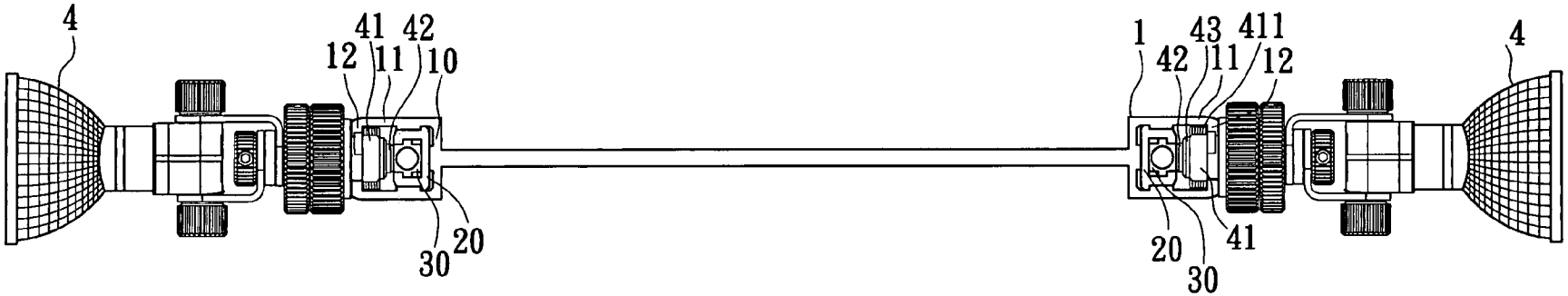
FIG. 10 is a side view of the track light assembly adopted for a track light of according to a fifth embodiment of the present invention.

FIG. 10 illustrates a fifth embodiment providing a plurality of the sidewalls 11 and retaining members 12 in an alternate arrangement for the assembly of more lamps 4.

The track light assembly of the present invention is equipped with a low voltage power of 12 volts, which is less than a safe power limit of 24 volts and is a conventional technique in the prior art. The track light assembly of the present invention is safe for general use.

Thus, the present invention is characterized by the two retaining members 12 inwardly extending from the two sidewalls 11 for the first electrode 41 mating with the cutout 14 of the conduction track 1, and the first electrode 41 is capable of abutting against the two retaining members 12 after turning. The track light assembly connects to the track light in a firm and engaging manner with an easy assembly and removal, and can prolong the life thereof accordingly.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A track light assembly adopted for a track light, comprising:

a conduction track made of conductive materials, the conduction track including two lateral sidewalls opposing each other, two lateral retaining members extending inwardly from the two lateral sidewalls respectively, a cavity formed between the two lateral sidewalls, and a cutout formed between the two lateral retaining members and communicating with the cavity;

an insulation strip disposed in the cavity and having an opening relating to the cutout; and a conduction strip made of conductive materials, the conduction strip partially disposed in the insulation strip and partially exposed by the insulation strip via the opening;

wherein the conduction track includes a base, the two lateral sidewalls have two upper portions extending from two lateral sides of the base, the two lateral retaining members extend inwardly from two lower portions of the two lateral sidewalls respectively, each lateral retaining member has a first conductive surface facing the cavity and a side retaining surface adjacent to the cutout, and the conduction strip includes a second conductive surface exposed by the insulation strip via the opening; and, wherein the conduction track includes three embosses extending inwardly from the base and the two lateral sidewalls, respectively, two slots are formed between the three embosses, the insulation strip includes a partition wall and two side wings laterally extending from the partition wall outwardly, and the partition wall abuts against the three embosses and the two side wings mate with the two slots.

2. The track light assembly as claimed in claim 1, wherein the insulation strip includes a partition wall and two opposing flanges extending inwardly from the partition wall, the partition wall includes a slot formed therein, the opening is formed between the two opposing flanges to communicate with the slot, the conduction strip includes a base disposed in the slot, and two projecting members outwardly extend from the base and retain against the two opposing flanges, respectively.

3. The track light assembly as claimed in claim 1, wherein the cutout and the opening are gradually reduced.

4. The track light assembly as claimed in claim 1, wherein the conduction strip has two connection holes formed on two opposing ends thereof.

5. The track light assembly as claimed in claim 1, wherein the conduction track has a horseshoe-shaped end surface.

6. The track light assembly as claimed in claim 1, wherein the insulation strip has a horseshoe-shaped end surface.

7. The track light assembly as claimed in claim 1, wherein the conduction strip has a cruciform end surface.

8. A track light, comprising:

a conduction track made of conductive materials, the conduction track including two lateral sidewalls opposing each other, two lateral retaining members extending inwardly from the two lateral sidewalls respectively, a cavity formed between the two lateral sidewalls, and a cutout formed between the two lateral retaining members and communicating with the cavity;

an insulation strip disposed in the cavity and having an opening relating to the cutout;

a conduction strip made of conductive materials, and the conduction strip partially disposed in the insulation strip and partially exposed by the insulation strip via the opening; and a lamp including a first electrode disposed in the cavity via the cutout and abutting against the two lateral retaining members for electrically connecting the conduction track, and a second electrode electrically connecting the conduction strip via the opening and the cutout;

wherein the conduction track includes a base, the two lateral sidewalls have two upper portions extending from two lateral sides of the base, the two lateral retaining members extend inwardly from two lower portions of the two lateral sidewalls respectively, each lateral retaining member has a first conductive surface facing the cavity and a side retaining surface adjacent to the cutout, and the conduction strip includes a second conductive surface exposed by the insulation strip via the opening; and, wherein the conduction track includes three embosses extending inwardly from the base and the two lateral sidewalls, respectively, two slots are formed between the three embosses, the insulation strip includes a partition wall and two side wings laterally extending from the partition wall outwardly, and the partition wall abuts against the three embosses and the two side wings mate with the two slots.

* * * * *